US009422778B2

(12) United States Patent
Angelle et al.

(10) Patent No.: US 9,422,778 B2
(45) Date of Patent: Aug. 23, 2016

(54) DRILL PIPE HANDLING SYSTEM

(71) Applicant: Frank's International, LLC, Houston, TX (US)

(72) Inventors: Jeremy R. Angelle, Youngsville, LA (US); Logan E. Smith, Youngsville, LA (US); Robert L. Thibodeaux, Lafayette, LA (US); John E. Stelly, Breaux Bridge, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 323 days.

(21) Appl. No.: 14/194,930

(22) Filed: Mar. 3, 2014

(65) Prior Publication Data

US 2015/0247367 A1 Sep. 3, 2015

(51) Int. Cl.

| | |
|---|---|
| ***E21B 19/07*** | (2006.01) |
| ***E21B 19/06*** | (2006.01) |
| ***E21B 19/10*** | (2006.01) |

(52) U.S. Cl.

CPC ..... *E21B 19/07* (2013.01); *E21B 19/06* (2013.01); *E21B 19/10* (2013.01)

(58) Field of Classification Search

CPC ..... E21B 19/07; E21B 19/06; E21B 19/10; E21B 19/02; E21B 19/12; E21B 19/00; E21B 19/16; E21B 19/20; F16L 3/00

See application file for complete search history.

(56) References Cited

U.S. PATENT DOCUMENTS 1,674,144 A 6/1928 Traves
3,915,244 A * 10/1975 Brown ..... E21B 19/20 166/77.52
6,644,413 B2 11/2003 Adams et al.
6,920,931 B1 7/2005 Webre et al.
7,287,598 B2 * 10/2007 Adams ..... E21B 19/002 166/382
7,337,853 B2 3/2008 Buytaert et al.
8,082,997 B2 12/2011 Webre et al.
2009/0056930 A1 3/2009 Angelle et al.
2009/0252589 A1 10/2009 Sonneveld et al.
2010/0059231 A1 3/2010 Thomas et al.
2011/0147011 A1 * 6/2011 Thibodeaux, Jr. ..... E21B 19/10 166/382
2012/0261528 A1 10/2012 Stoldt et al.
2012/0326459 A1 * 12/2012 Angelle ..... E21B 19/07 294/90
2013/0228339 A1 9/2013 Adams et al.

FOREIGN PATENT DOCUMENTS

EP 2028339 A1 2/2009
WO 2005003504 A2 1/2005

OTHER PUBLICATIONS

Jin Ho Kim (Authorized Officer), International Search Report and Written Opinion dated May 27, 2015, International Application No. PCT/US2015/015747, filed Feb. 13, 2015, pp. 1-18.

* cited by examiner

*Primary Examiner* — Yong-Suk (Philip) Ro
(74) *Attorney, Agent, or Firm* — MH2 Technology Law Group, LLP

(57) ABSTRACT

An elevator, apparatus, and method for handling a tubular, of which the apparatus includes a body defining at least a portion of a tapered bowl. The apparatus also includes a plurality of slips disposed at least partially within the bowl and configured to slide along a surface of the bowl. Each of the slips includes a radial engaging surface configured to engage an outer diameter of a tubular, and a tapered engaging surface configured to engage a tapered section of the tubular.

24 Claims, 5 Drawing Sheets

DRILL PIPE HANDLING SYSTEM

BACKGROUND

In many oilfield operations, e.g., drilling, casing running, etc., a tubular is run into the wellbore. During run-in, the tubular is typically connected to, i.e., made-up to, one or more tubulars that have already been run-in, thus providing an end-on-end connection forming a tubular string. In some cases, elevators are employed to position the tubular above the wellbore, allowing the tubular to be made-up to the subjacent, already-run tubular. The elevator then supports the weight of the tubular string through its engagement with the tubular, and lowers the tubular into the wellbore.

There are several different types of elevators, which employ different structures to engage the tubular and support its weight. Generally, elevators either employ slips that engage the radial outside of the tubular, or a load bushing that catches an upset (e.g., a shoulder) of the tubular or a lift nubbin connected to the top of the tubular. Slip-type elevators generally use the weight of the tubular to provide the gripping force, and may include teeth or the like that bite into the tubular. Load bushing elevators, by contrast, provide a collar or landing surface upon which the upset bears.

Both types of elevators present challenges in deep sea or other applications where the tubular strings can become extremely heavy. With slip-type elevators, after making the tubular up to the string, the weight of the tubular can cause the slips to apply too great of a gripping force on the tubular, which can crush or otherwise damage the tubular. Further, in some applications, it may be advantageous or required to avoid marking the tubular. On the other hand, with load-bushing-type elevators, the upset of the tubular, e.g., where the tool joint is coupled with the pipe, may fail if the weight is too great. One solution is to form higher-grade tool joints that are designed to support the load; however, such higher-grade tool joints may result in higher make-up torques, which can present additional challenges.

SUMMARY

Embodiments of the disclosure may provide an apparatus for handling a tubular. The apparatus includes a body defining at least a portion of a tapered bowl. The apparatus also includes a plurality of slips disposed at least partially within the bowl and configured to slide along a surface of the bowl. Each of the slips includes a radial engaging surface configured to engage an outer diameter of a tubular, and a tapered engaging surface configured to engage a tapered section of the tubular.

Embodiments of the disclosure may also provide a method for handling a tubular. The method includes receiving a tubular into a body of an elevator, and moving slips of the elevator with respect to a tapered bowl of the elevator. The method also includes engaging a main body section of the tubular with a radial engaging surface of each of the slips, and engaging a tapered section of the tubular with a tapered engaging surface of each of the slips.

Embodiments of the disclosure may also provide an elevator for lifting a tubular. The elevator includes a body defining a tapered bowl. The elevator also includes a plurality of slips coupled with the body and movable at least partially in the tapered bowl. The plurality of slips each comprise a radial engaging surface extending axially and a tapered engaging surface extending at an angle of between about 10 degrees and 60 degrees to the radial engaging surface. The tapered engaging surface is configured to engage a tool joint of a tubular and the radial engaging surface is configured to engage and apply a friction force to an outer diameter of the tubular, the outer diameter being adjacent to the tapered surface.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate an embodiment of the present teachings and together with the description, serve to explain the principles of the present teachings. In the figures.

Figure 1:
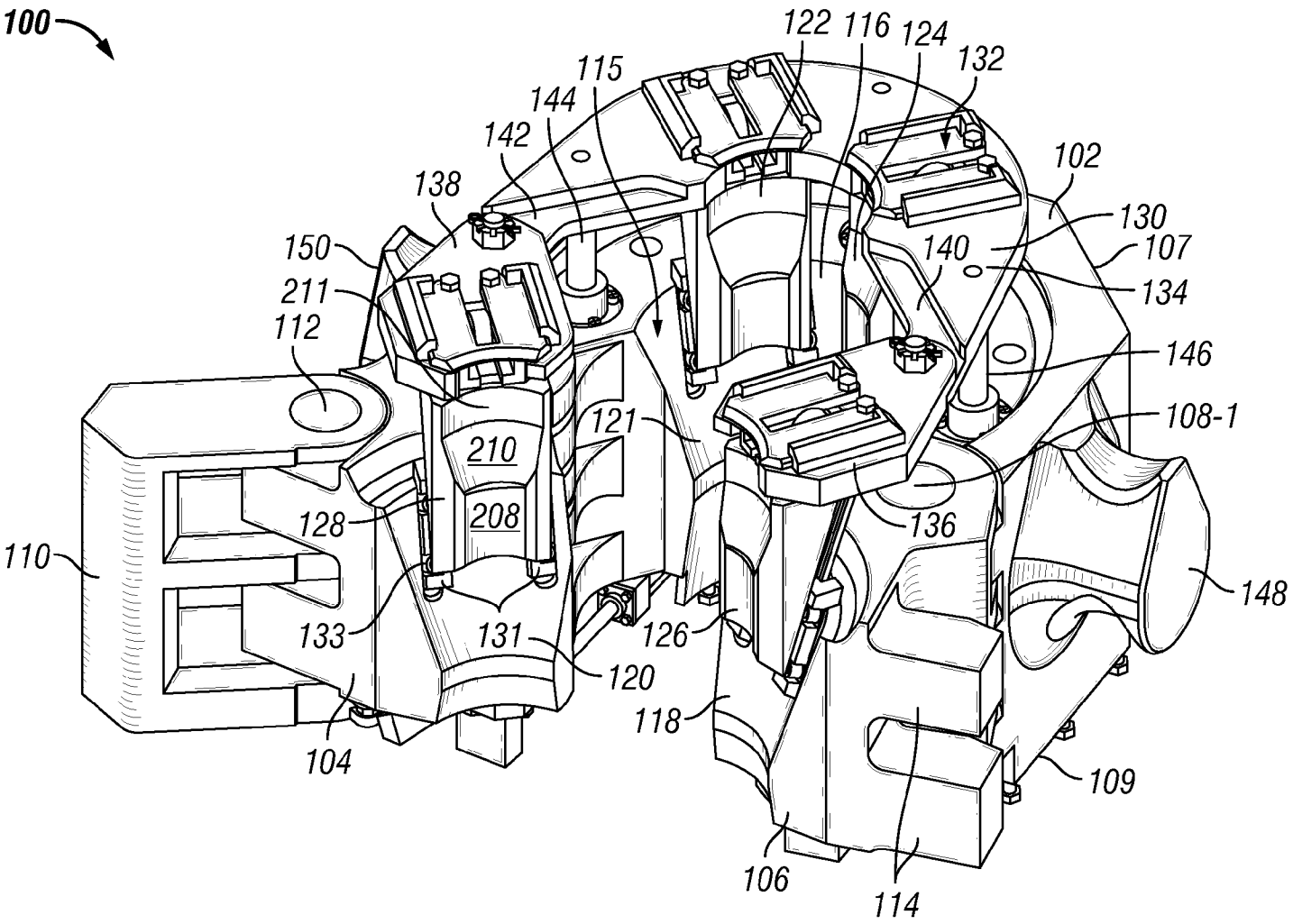
FIG. 1 illustrates a raised perspective view of an elevator, with doors thereof open, according to an embodiment.

It should be noted that some details of the figures have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawings. In the drawings, like reference numerals have been used throughout to designate identical elements, where convenient. In the following description, reference is made to the accompanying drawings that form a part of the description, and in which is shown by way of illustration a specific embodiment, among many contemplated, in which the present teachings may be practiced.

FIG. 1 illustrates a raised perspective view of an elevator 100, according to an embodiment. The elevator 100 may generally be configured for use in drilling, casing, or other types of tubular running systems. Accordingly, the elevator 100 may be configured to support a weight of a tubular (not shown in FIG. 1) and lower the tubular into connection with a subjacent (i.e., already run) tubular, e.g., as part of a string of tubulars such as a drill string. Further, the elevator 100 may be configured to lower the tubular, after being made up to the tubular string, into the wellbore, while supporting the weight of the tubular string. The elevator 100 may also be configured to allow the weight of the tubular string to be transferred to a spider or another structure located proximal the wellbore, and may then be disengaged from the tubular, lifted, and engaged with another tubular to repeat the process. Additionally, embodiments of the elevator 100 may be applied to lift tubular from a horizontal, or any other non-vertical, starting orientation, as will be described in greater detail below.

In an embodiment, the elevator 100 may include a body 102 and one or more, for example, two doors 104, 106. The body 102 may also include a top 107 and a bottom 109, and may form at least a portion of a cylindrical structure. In some cases, the doors 104, 106 may be omitted, with the body 102 providing the entire cylindrical structure. In other cases, a single door, or three or more doors, may be employed. In the illustrated embodiment, the doors 104, 106 may be coupled with the body 102 so as to pivot with respect thereto. For example, the doors 104, 106 may be coupled with the body 102 via pins 108-1, 108-2 (pin 108-2 is not visible in FIG. 1), respectively. When closed, the doors 104, 106 may be restrained together via a latch 110. The latch 110 may be pivotally coupled with the door 104 via a pin 112, and may be receivable between knuckles 114 of the opposite door 106. In embodiments including doors 104, 106, when the doors 104, 106 are closed, the doors 104, 106 and the body may from a generally cylindrical structure.

In an embodiment, the body 102 and the doors 104, 106 may together define a bowl 115, e.g., when the doors 104, 106 are closed. For example, the body 102 may provide a bowl section 116 and the doors 104, 106 may provide bowl sections 118, 120. The bowl sections 116-120 may combine to form a generally frustoconical surface 121, which may decrease in diameter proceeding away from the top 107 of the body 102. In embodiments in which the doors 104, 106 are omitted, the body 102 may provide the entire surface 121.

The elevator 100 may also include a plurality of slips (four shown: 122, 124, 126, and 128). Although four slips 122-126 are shown in the illustrated embodiment, it will be appreciated that additional or fewer slips may be employed. Further, the slips 126, 128 may be coupled with the doors 104, 106, respectively. In this case, the slips 126, 128 may be configured to swing or pivot with the doors 104, 106.

The slips 122-128 may each be configured to slide or otherwise move along the surface 121 of the bowl 115, thereby increasing or decreasing their radial distances from the center of the elevator 100 according to the axial position of the slips 122-128 on the tapered bowl 115. Further, the elevator 100 may include guide bars 131 for each of the slips 122-128, which may be coupled with and extend inward from the surface 121 of the bowl 115. The guide bars 131 may include a friction-reducing feature, such as rollers 133, as shown, low-friction surfaces, and/or the like. Such friction-reducing features may be configured to facilitate sliding of the slips 122-128 with respect thereto. In other embodiments, friction-reducing features may be omitted. Further, the guide bars 131 may be received into a recess formed in the slips 122-128, may ride against the circumferential edges of the slips 122-128 to which they are adjacent, or may be spaced apart from the slips 122-128 unless the slips 122-128 are displaced. The guide bars 131 may be configured to constrain the position of the slips 122-128, e.g., when engaged with a tubular, so as to prevent movement of the tubular from displacing or otherwise damaging the slips 122-128 or other components of the elevator 100 connected thereto.

The slips 122-128 may be connected together via a timing ring 130. For example, each of the slips 122-128 may be coupled with the timing ring 130 via a pin-and-slot connection 132, which may allow the slips 122-128 to move radially with respect to the timing ring 130. Further, the timing ring 130 may include a main section 134 and two swing sections 136, 138. The swing sections 136, 138 may be pivotally coupled with the main section 134, aligned with the doors 104, 106 and coupled with the slips 126, 128 disposed thereon, respectively. Additionally, the swing sections 136, 138 may be receivable at least partially onto shoulders 140, 142 at circumferential extents of the main section 134.

The main section 134 may be coupled with one or more extendable cylinders (two are visible: 144, 146). The extendable cylinders 144, 146 may also be coupled with the body 102 and may be extendable upward and retractable downward with respect thereto, so as to drive the timing ring 130 toward or away from the body 102. The extendable cylinders 144, 146 may be driven using hydraulics or pneumatics, or mechanically or electro-mechanically driven. Further, with the swing sections 136, 138 received onto the shoulders 140, 142, when the extendable cylinders 144, 146 drive the main section 134 upward, the main section 134 in turn drives the swing sections 136, 138 upward.

The body 102 may also be coupled with ears 148, 150, which may be configured to engage bails attached to a travelling block or another component of a drilling rig, for example. In some cases, the body 102 and the ears 148, 150 may be integrally formed, such that that body 102 may be considered to include the ears 148, 150. This may allow the elevator 100 to be moved, e.g., lifted and lowered, at least, so as to enable control of the position of a tubular that the elevator 100 engages. In other embodiments, other structures of the elevator 100 may be provided to connect with the lifting mechanism.

Figure 2:
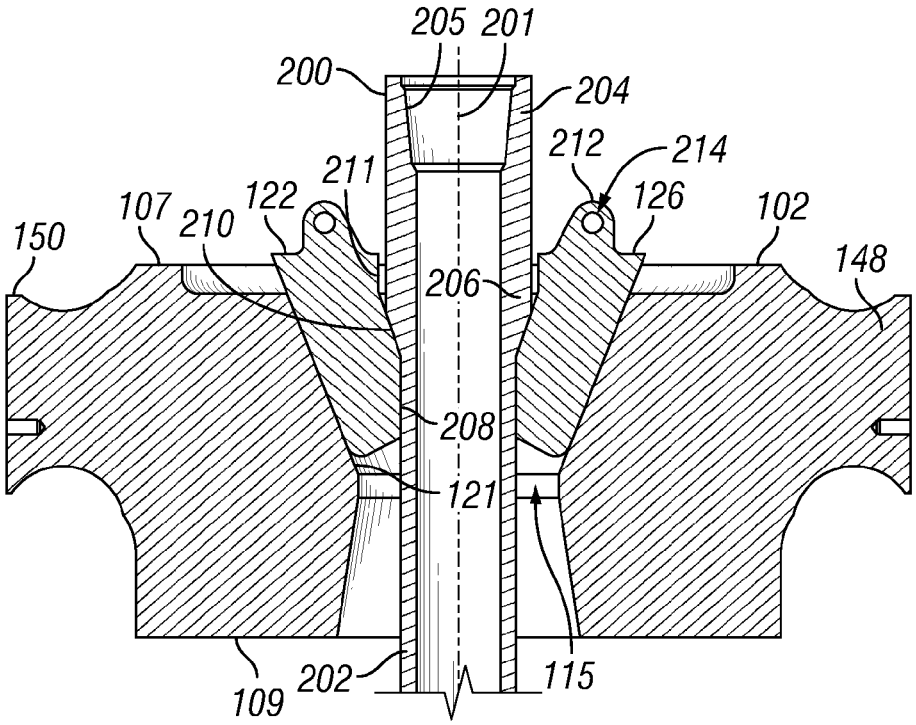
FIG. 2 illustrates a partial cross-sectional view of the elevator, according to an embodiment.

FIG. 2 illustrates a side cross-sectional view a portion of the elevator 100, without the timing ring 130, according to an embodiment. The slips 122-128 (slips 122 and 126 are shown in FIG. 2) may be configured to engage a tubular 200 and to disengage therefrom by moving axially, i.e., parallel to a longitudinal centerline 201 of the elevator 100 and along the surface 121 of the bowl 115. With the surface of the bowl 115 being tapered, such axial movement may translate into radial movement away from (when moving upward) and toward (when moving downward) the longitudinal centerline 201.

The tubular 200 may be a drill pipe and may include a main body section 202 and a tool joint 204. The tool joint 204 may form a box-end (e.g., an internally or "female" threaded) connection 205, which may be configured to receive a pin-end connection of another tubular. Further, the tool joint 204 may define a tapered section 206, where the outer diameter of the tool joint 204 may decrease toward the outer diameter of the main body section 202. It will be appreciated that the tool joint 204 may form a weld neck with the main body section 202, e.g., where the tool joint 204 connects with the main body section 202. In other embodiments, the tool joint 204 may be integral with the main body section 202, or otherwise attached thereto. Further, in some cases the tapered section 206, for lifting purposes, may be provided by a lift-nubbin threaded into the box-end connection 205. The main body section 202 may proceed along at least a majority of the length of the tubular 200 and may generally define the outer diameter thereof, apart from at the tool joint 204.

With reference to FIGS. 1 and 2, one or more of the slips 122-128 may include a radial engaging surface 208 and a tapered engaging surface 210. In the illustrated embodiment, all of the slips 122-128 include both surfaces 208, 210; however, embodiments in which one or more of the slips 122-128 omit one or both of the surfaces 208, 210 are contemplated.

As can be appreciated from FIGS. 1 and 2, the radial engaging surface 208 may be curved, e.g., partially around the longitudinal centerline 201. However, the radial engaging surface 208 may be generally straight in the axial direction, in cross-section, such that the radial engaging surface 208 may extend generally parallel to the longitudinal centerline 201. This geometry may allow the radial engaging surface 208 to contact or otherwise engage the generally constant outer diameter of the main body section 202. In an embodiment, the radial engaging surface 208 may be substantially free from marking bodies, such as teeth, that would bite into the outer diameter of the main body section 202. Thus, an engagement between the main body section 202 and the radial engaging surface 208 may be substantially non-marking.

The tapered engaging surface 210 may also be curved circumferentially at least partially about the longitudinal centerline 201. Further, the tapered engaging surface 210 may be inclined at an angle to the longitudinal centerline 201 in radial cross-section, as illustrated. The inclination angle of the tapered engaging surface 210 may be generally the same as the inclination angle at which the tapered section 206 of the tool joint 204 is disposed. Accordingly, the tapered engaging surface 210 may engage the tapered section 206 of the tool joint 204. In an example, the tapered engaging surface 210 may have an inclination to the longitudinal centerline 201 defining an angle of between about 10 degrees and about 60 degrees, between about 12 degrees and about 45 degrees, between about 15 degrees and about 30 degrees, or for example, about 18 degrees. The inclination angle of the surface 121 of the bowl 115 may be the same or different than the inclination angle of the tapered engaging surface 210. In various embodiments, the inclination angle of the tapered bowl 115 to the centerline 201 may be between about 10 degrees and about 60 degrees, between about 12 degrees and about 45 degrees, between about 15 degrees and about 30 degrees, or for example, about 17 degrees.

Further, in an embodiment, the radial engaging surface 208 may be disposed below the tapered engaging surface 210, i.e., the tapered engaging surface 210 may be disposed between the radial engaging surface 208 and the timing ring 130. As shown in FIG. 1, the timing ring 130 may be disposed proximal the top 107 of the body 102 and may move with the slips 122-128; thus, in one particular embodiment, the tapered engaging surface 210 may remain between the radial engaging surface 208 and the timing ring 130, notwithstanding the position of the slips 122-128 with respect to the body 102. As shown, the tapered section 206 of the tool joint 204 may generally extend upward from the main body section 202; thus, positioning the tapered engaging surface 210 above the radial engaging surface 208 may allow the radial engaging surface 208 to grip the outer diameter of the main body section 202, while the tapered engaging surface 210 engages the tool joint 204 (e.g., the tapered section 206 thereof).

As such, in use, the radial engaging surfaces 208 of the slips 122-128 may engage the bowl 115 and the outer diameter of the main body section 202. This engagement between the radial engaging surface 208 and the main body section 202 may create friction forces between the tubular 200 and the slips 122-128, forcing the slips 122-128 downward in the bowl 115 and inward, into tighter engagement with the outer diameter of the main body section 202, thereby increasing the gripping ability of the slips 122-128.

It will be appreciated that terms implying an orientation, such as "up," "down," "above," "below," "top," "bottom," "left," "right," and the like, are used for convenience in referring to the Figures. Such terms are merely indicative of relative position and are not to be considered as limiting the elevator 100 to any particular orientation.

Returning to FIG. 2, in some cases, the slips 122-128 may also include a third section 211 disposed above the tapered engaging surface 210, i.e., between the tapered engaging surface 210 and the timing ring 130 (FIG. 1). The third section 211 may be parallel or inclined relative to the longitudinal centerline 201. Further, the third section 211 may be larger, in an embodiment, than an outer diameter of the tool joint 204, and thus the third section 211 may be spaced apart from the tool joint 204 when the slips 122-128 engage the tubular 200. However, embodiments in which the third section 211 bears on the tool joint 204 are contemplated. Further, embodiments in which the tapered engaging surface 210 forms the upper axial extent of each of the slips 122-128 are also contemplated.

FIG. 2 also illustrates a linkage 212 of the slips 122-128, which provides part of the connection 132 between the slips 122-128 and the timing ring 130 (FIG. 1). For example, the linkage 212 may couple the slips 122-128 to the timing ring 130 via a pin received through an aperture 214 defined in the linkage 212. Moreover, when the slips 122-128 move (e.g., via the linkage 212 and the timing ring 130), the slips 122-128 may not engage a landing surface in the bowl 115. Rather, the bowl 115 may allow the slips 122-128 to slide down, as shown, and inward into engagement with the tubular 200, without restricting the movement thereof. However, it will be appreciated that the slips 122-128 may be prevented from sliding entirely through the body 102 by attachment with the timing ring 130 and/or by defining a circumference together that is greater than a smallest circumference of the bowl 115.

Figure 3:
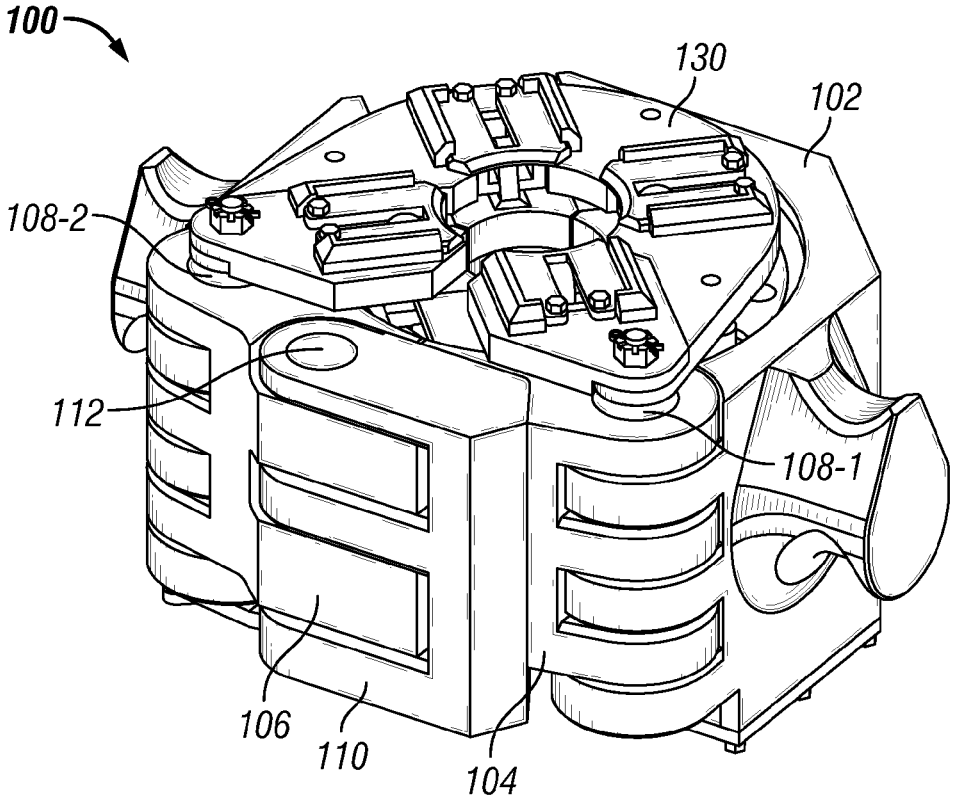
FIG. 3 illustrates a raised perspective view of the elevator, with the doors closed, according to an embodiment.

FIG. 3 illustrates a raised perspective view of the elevator 100, according to an embodiment, with the doors 104, 106 closed and the latch 110 engaged. The timing ring 130 may be lowered toward the top 107 of the body 102, for example, by removing hydraulic pressure from the extendable cylinders 144, 146 (FIG. 1). With additional reference to FIGS. 1 and 2, by removing the pressure from the extendable cylinders 144, 146, the timing ring 130 may fall toward the top 107 as the extendable cylinders 144, 146 retract. Thus, the slips 122-128 may proceed along the tapered bowl 115, moving radially inward as they move axially downward along the surface 121 of the tapered bowl 115 until engaging the tubular 200.

Once engaging the tubular 200, e.g., the tapered section 206 and/or the main body section 202, the elevator 100 may be moved upwards with respect to the tubular 200, such that the tapered engaging surface 210 of each of the slips 122-128 engages the tapered section 206 of the tool joint 204. Once the tapered engaging surfaces 210 engage the tapered section 206, and the radial engaging surfaces 208 engage the main body section 202, the weight of the tubular 200 may be transferred to the body 102 via the engagement between the slips 122-128 and the main body section 202 and the tapered section 206. In turn, the slips 122-128 may transmit the weight to the ears 148, 150 via the body 102 and/or the doors 104, 106. Bails attached to a lifting mechanism, may be coupled with the ears 148, 150, so as to control the position of the elevator 100 and the tubular 200, e.g., to lower the tubular 200 into a wellbore.

Accordingly, it will be seen that the slips 122-128 may avoid causing the connection (e.g., weld neck) between the tool joint 204 and the main body section 202 of the tubular 200 to fail. For example, the bowl 115 may not have a landing surface at an axial bottom thereof, and thus the slips 122-128 may be allowed to apply a radially-inward gripping force on the main body section 202 via engagement with the radial engaging surface 208, thus taking up some of the weight of the tubular 200 via friction forces between the main body section 202 and the radial engaging surfaces 208. Further, the tapered engaging surface 210 of the slips 122-128 may bear on the large surface area provided by the tapered section 206 of the tool joint 204. This may spread out the stress on the tool joint 204 caused by transmission of the tubular 200 weight to the body 102, so as to avoid a concentration thereof in the weld neck (i.e., where the tool joint 204 is connected to the tubular 200).

Figure 4:
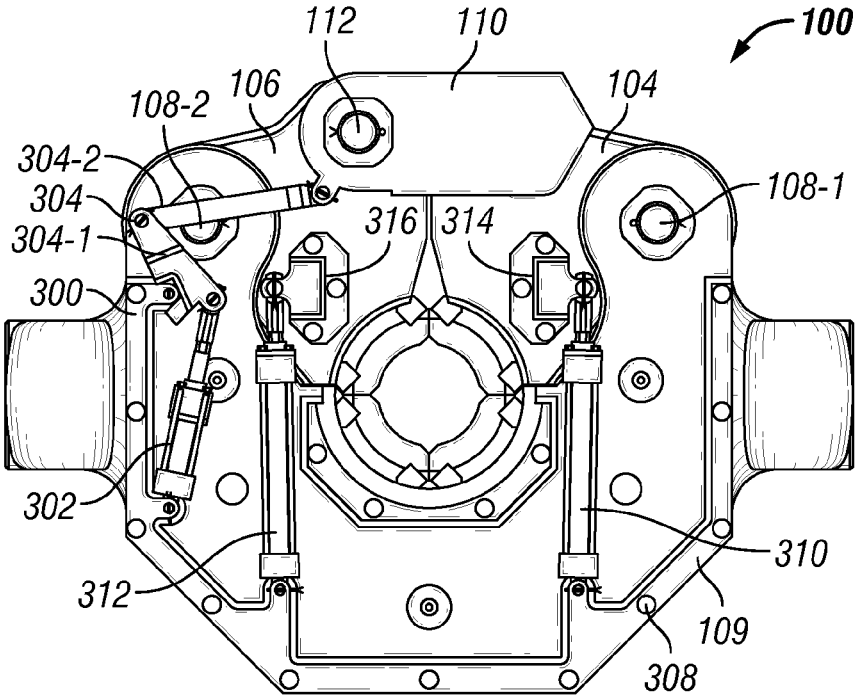
FIGS. 4-6 illustrate bottom views of the elevator, showing the doors opening, according to an embodiment.
Figure 5:
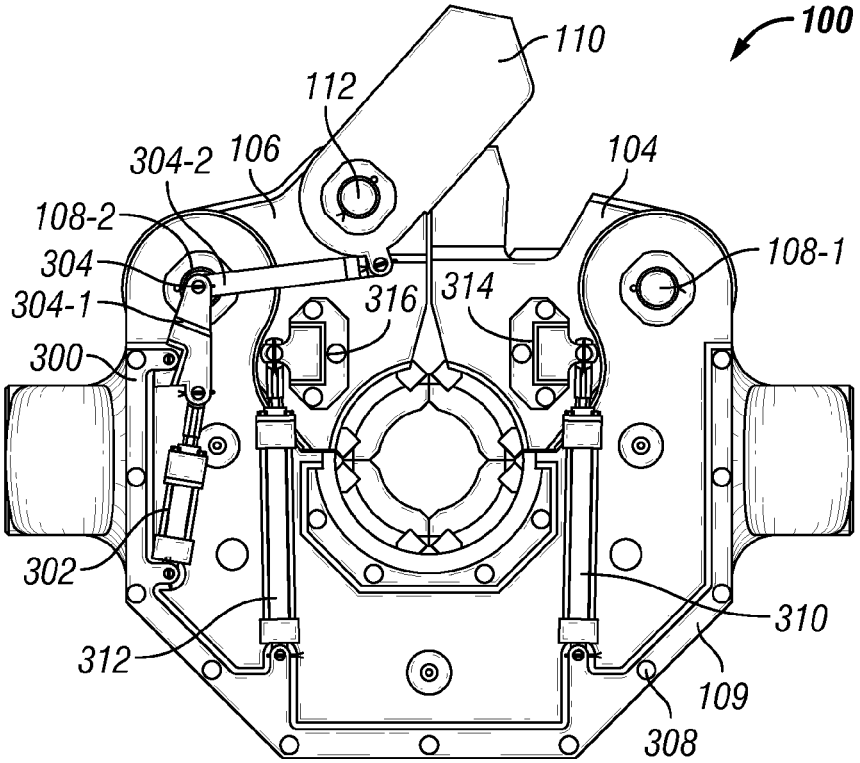
Figure 6:
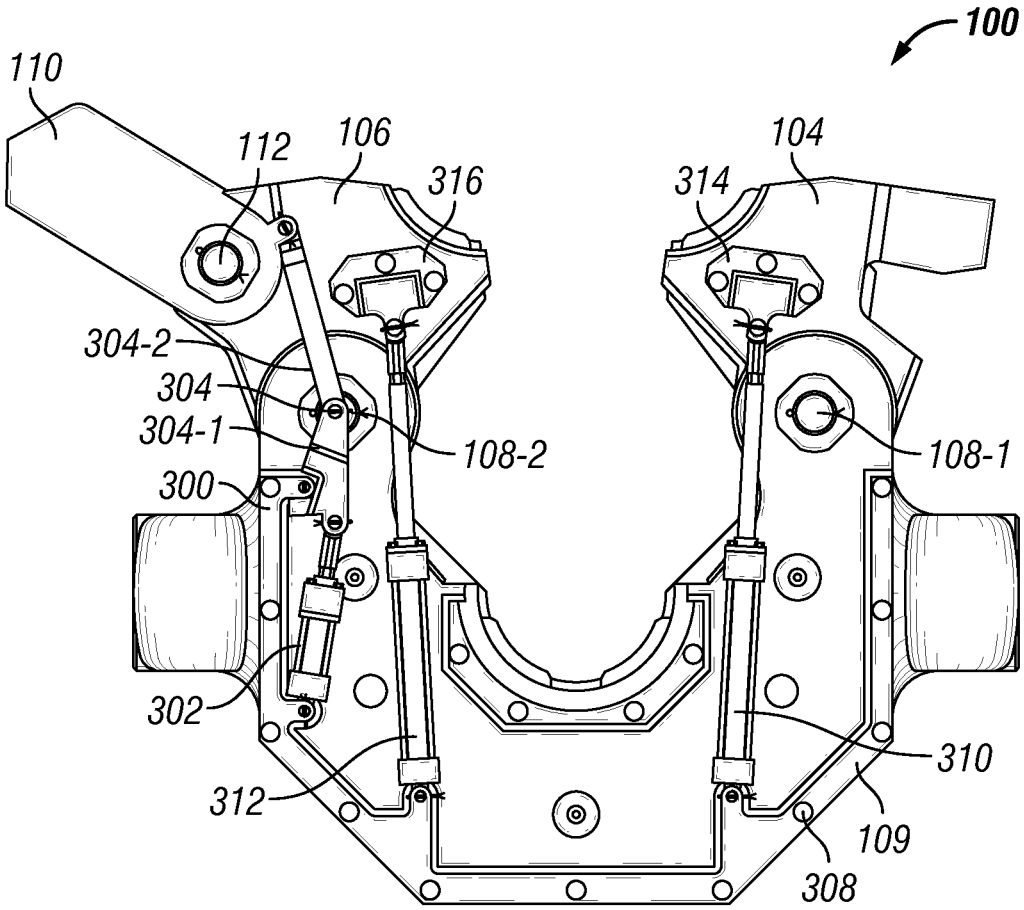

FIGS. 4-6 illustrate a view of the bottom 109 of the body 102 of the elevator 100, according to an embodiment. As shown, on the bottom 109, the body 102 may be recessed, so as to at least partially provide a space for an opening assembly, which may be hydraulic, pneumatic, mechanical, or electromechanical, for manipulating the doors 104, 106, and the latch 110. The opening assembly may include a bracket 300, a latch cylinder 302, and a latch linkage 304. The latch linkage 304 and the latch cylinder 302 may be pivotally coupled with the bracket 300. Further, the latch linkage 304 may include a first arm 304-1 and a second arm 304-2, with the first arm 304-1 being pivotally coupled with the latch cylinder 302 and the bracket 300, and the second arm 304-2 being pivotally coupled with the first arm 304-1 and the latch 110.

The opening assembly may also include a second bracket 308 and a plurality of door cylinders for example, two door cylinders 310, 312, one for each door 104, 106. The door cylinders 310, 312 may be pivotally coupled with the second bracket 308 and to the doors 104, 106, respectively, via a pivotal connection with door brackets 314, 316, respectively.

Referring specifically to FIG. 4, in the illustrated closed position, the latch cylinder 302 may be extended and the door cylinders 310, 312 retracted. To open the doors 104, 106, the latch 110 is first disengaged from the door 104. In an embodiment, to do so, the latch cylinder 302 is retracted, as shown in FIG. 5. This causes the first arm 304-1 to pivot clockwise, as shown, which drives the second arm 304-2 to the right. Driving the second arm 304-2 to the right causes the latch 110 to rotate about the pin 112 and thus pivot with respect to the door 106 and out of engagement with the door 104.

With the latch 110 disengaged, the door cylinders 310, 312 may be expanded, as shown in FIG. 6. The expansion of the door cylinders 310, 312 causes the doors 104, 106 to rotate about the pins 108-1, 108-2 and thus to pivot with respect to the body 102. The door cylinders 310, 312 may be expanded until a gap 320 between the doors 104, 106 is large enough to accept the tubular 200 into the bowl 115 so that the slips 122-128 may engage the tubular 200.

The controls for the extendable cylinders 144, 146 controlling the position of the timing ring 130, and thus the slips 122-128 may be separate or integrated with controls for the opening assembly for opening/closing the doors 104, 106. Further, a single command may issue, e.g., from a user via such controls, to open the doors 104, 106, beginning the two part process of disengaging the latch 110 and pivoting the doors 104, 106; however, in other embodiments, two separate commands may be provided.

Figure 7:
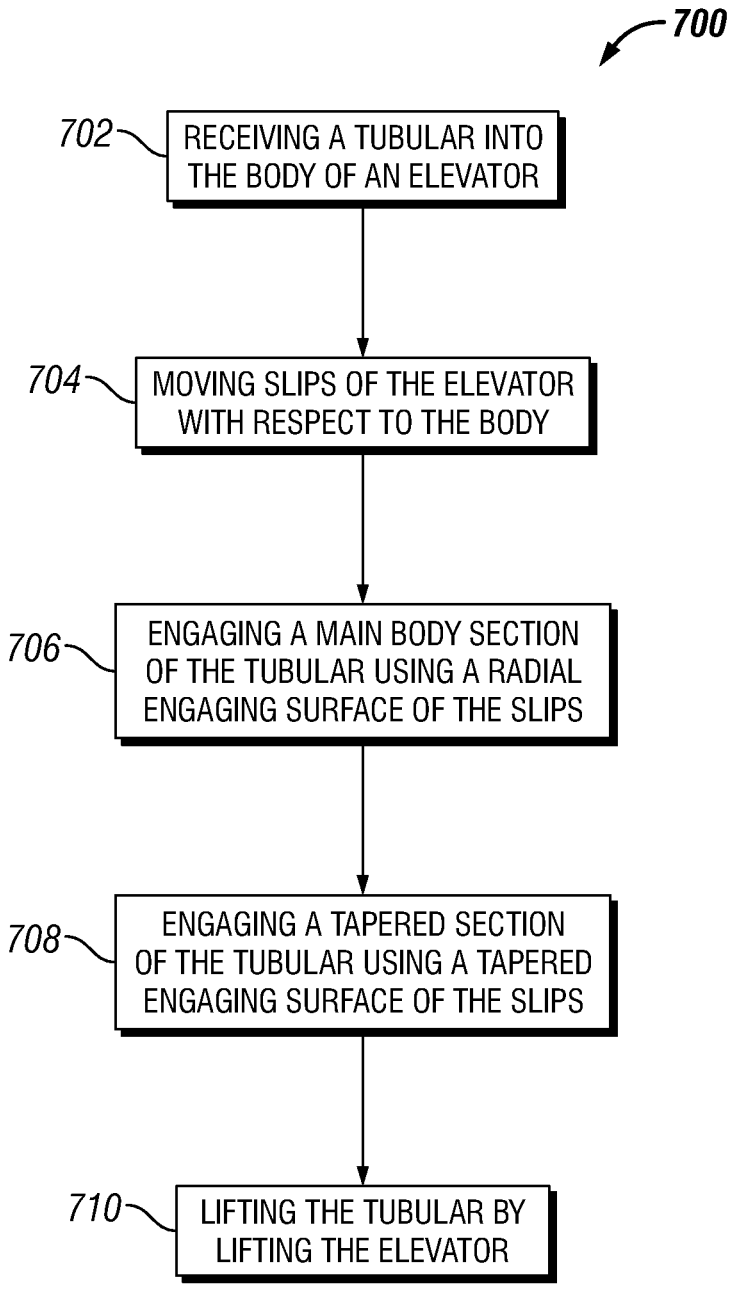
FIG. 7 illustrates a flowchart of a method for handling a tubular, according to an embodiment.

FIG. 7 illustrates a flowchart of a method 700 for handing the tubular 200, according to an embodiment. One or more embodiments of the method 700 may proceed by operation of the elevator 100; therefore, the method 700 is described with respect thereto. However, it will be appreciated that the method 700 is not intended to be limited to any particular structure unless otherwise expressly stated herein.

The method 700 may begin by receiving the tubular 200 into the body 102 of the elevator 100, as at 702. Once received, the body 102 may at least partially circumscribe the tubular 200. Such receiving may proceed, for example, by unlatching and/or pivoting the two doors 104, 106 apart from one another, so as to receive the tubular 200 laterally into the body 102. Such receiving may be suited for situations in which the tubular 200 begins in a horizontal or otherwise in a non-vertical position. Accordingly, the elevator 100 may be pivoted such that it is oriented generally parallel to the tubular 200, and receives the tubular 200 laterally through the doors 104, 106. Thereafter, the doors 104, 106 may be closed and latched.

In situations in which the tubular 200 is initially in a vertical orientation, the elevator 100 may be received over either end (e.g., the box end connection 205), with the slips 122-128 up, allowing for a radial clearance between the tubular 200 and the slips 122-128. It will be appreciated however that the doors 104, 106 may be employed in receiving the elevator 100 around the tubular 200 in a vertical start, while the elevator 100 may be received over the end of the tubular 200 in a horizontal or otherwise non-vertical starting orientation.

The method 700 may also include moving, e.g., lowering, the slips 122-128 with respect to the tapered bowl 115 defined at least in the body 102 of the elevator 100, as at 704. The slips 122-128 may be moved by actuation of the timing bar 130 connected to the extendable cylinders 144, 146. Moving the slips 122-128 axially with respect to the body 102 may cause the slips 122-128 to slide along the tapered surface 121 of the bowl 115, which, in turn, causes the radial position of the slips 122-128 to change according to the inclination of the tapered surface 121.

As the slips 122-128 are moved, the radial engaging surface 208 may be brought into engagement with the main body section 202 of the tubular 200, as at 706. Further, the tapered engaging section 210 may be brought into engagement with the tapered section 206 of the tubular 200, as at 708. The tapered section 206 of the tubular 200 may form part of a tool joint 204, which provides a box-end (internally threaded) connection 205 for attachment to another tubular 200, or may be provided by another structure such as a lift nubbin. Accordingly, by the engaging at 706 and 708, the elevator 100 may transfer weight from the tubular 200 to the body 102 via the slips 122-128 engaging both the main body section 202 and the tapered section 206.

Further, in an embodiment, one or more of the slips 122-128 (e.g., slips 126, 128, as shown in FIG. 1) may slide along the bowl section 118 or 120 defined by the doors 104, 106, respectively. The timing ring 130 may be segmented, such that the slips 126, 128 may swing with the opening and closing doors 104, 106. Additionally, in some cases, the bowl 115 may not end at a radially-extending landing surface and may, instead, be free to apply a gripping force on the main body section 202. In at least one specific embodiment, one, some, or all of the slips 122-128 may slide between two guide bars 131 disposed circumferentially adjacent to the one, some, or all of the slips 122-128, with the guide bars 131 extending from the surface 121 of the tapered bowl 115.

The method 700 may also include lifting the tubular 200 by lifting the elevator 100, as at 710. The elevator 100 may be lifted, for example, via engagement with the ears 148, 150. Initially, lifting the elevator 100 may cause the elevator 100 to move with respect to the tubular 200, until the tapered section 206 lands on the tapered engaging section 210 of the slips 122-128. Thereafter, continued lifting of the elevator 100 may cause the slips 122-128 to take up the weight of the tubular 200, without the slips 122-128 bearing against an axial shoulder or landing surface, so as to transfer the weight of the tubular 200 to the bowl 115 and the body 102, for example. The lifting of the tubular 200 at 710 may apply in vertical, horizontal, or otherwise non-vertical orientations of the tubular 200. In horizontal or otherwise non-vertical orientations, in addition to vertical lifting, at least initially, the lifting at 710 may include pivoting the elevator 100 to rotate the tubular 200 to a vertical orientation.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An apparatus for handling a tubular, comprising:

a body defining at least a portion of a tapered bowl; and a plurality of slips disposed at least partially within the bowl and configured to slide along a surface of the bowl, wherein each of the slips comprises a radial engaging surface configured to engage an outer diameter of a tubular, and a tapered engaging surface configured to engage a tapered section of the tubular, wherein the tapered bowl does not include a radial landing surface against which the plurality of slips engage to prevent axial movement thereof relative to the tapered bowl.

2. The apparatus of claim 1, wherein the radial engaging surface and the tapered engaging surface are configured to be in engagement with the tubular at the same time, wherein the radial engaging surface is configured to apply a friction force to the tubular.

3. The apparatus of claim 1, further comprising a timing ring coupled to the plurality of slips, wherein the tapered engaging surface is between the radial engaging surface and the timing ring.

4. The apparatus of claim 1, wherein the radial engaging surface is parallel to a longitudinal centerline through the body.

5. The apparatus of claim 1, wherein the tapered engaging surface is inclined relative to a longitudinal centerline through the body at a first angle of between about 10 degrees and about 60 degrees.

6. The apparatus of claim 5, wherein the first angle is about 18 degrees.

7. The apparatus of claim 5, wherein the surface of the tapered bowl is inclined relative to the centerline at a second angle of between about 10 degrees and about 60 degrees.

8. The apparatus of claim 7, wherein the second angle is about 17 degrees.

9. The apparatus of claim 1, wherein the bowl is free from axial landing surfaces.

10. The apparatus of claim 1, further comprising one or more doors pivotally coupled with the body, wherein the one or more doors define a section of the tapered bowl.

11. The apparatus of claim 10, wherein at least one of the plurality of slips slides along the section of the tapered bowl defined by the one or more doors.

12. The apparatus of claim 10, further comprising one or more guide bars disposed on the tapered bowl circumferentially adjacent to at least one of the plurality of slips.

13. The apparatus of claim 10, wherein the one or more doors comprises a first door and a second door, the apparatus further comprising:

a latch pivotally coupled with the first door and engageable with the second door; and an opening assembly coupled with the body, the latch, and first and second doors, wherein the opening assembly is configured to pivot the latch out of engagement with the second door and to pivot the first and second doors away from one another.

14. A method for handling a tubular, comprising:

receiving a tubular into a body of an elevator;

moving slips of the elevator with respect to a tapered bowl of the elevator, wherein the tapered bowl does not include a radial landing surface against which the slips engage to prevent axial movement thereof relative to the tapered bowl;

engaging a main body section of the tubular with a radial engaging surface of each of the slips; and engaging a tapered section of the tubular with a tapered engaging surface of each of the slips.

15. The method of claim 14, wherein moving the slips comprises lowering the slips in the tapered bowl.

16. The method of claim 14, wherein engaging the tapered section of the tubular comprises engaging a tool joint coupled with the main body section of the tubular.

17. The method of claim 14, wherein receiving the tubular into the body comprises pivoting apart two doors coupled with the body.

18. The method of claim 17, wherein lowering the slips comprises sliding at least one of the slips along a bowl section defined by at least one of the two doors.

19. The method of claim 17, further comprising:

raising the elevator such that the slips transfer a load from the tubular to the elevator without engaging an axial landing surface of the elevator.

20. The method of claim 19, wherein moving the slips further comprises sliding at least one of the slips between two guide bars disposed circumferentially adjacent to at least one of the slips and extending from the surface of the tapered bowl.

21. The method of claim 14, wherein engaging the tapered section of the tubular comprises:

causing a substantially non-marking engagement between the slips and the tapered section, such that a friction force is generated by the substantially non-marking engagement when the elevator is lifted.

22. An elevator for lifting a tubular, comprising:

a body defining a tapered bowl; and a plurality of slips coupled with the body and movable at least partially in the tapered bowl, wherein the plurality of slips each comprise a radial engaging surface extending axially and a tapered engaging surface extending at an angle of between about 10 degrees and 60 degrees to the radial engaging surface, wherein the tapered engaging surface is configured to engage a tool joint of a tubular and the radial engaging surface is configured to engage and apply a friction force to an outer diameter of the tubular, the outer diameter being adjacent to the tapered surface, and wherein the tapered bowl does not include a radial landing surface against which the plurality of slips engage to prevent axial movement thereof relative to the tapered bowl.

23. The elevator of claim 22, wherein at least one of the plurality of slips comprises a third section disposed above the tapered engaging surface, the third section extending generally parallel to the radial engaging surface.

24. The elevator of claim 23, wherein the third section is configured to be spaced apart from the tool joint of the tubular when the radial engaging surface engages the outer diameter of the tubular.

* * * * *